US009129784B2

(12) United States Patent
Choi et al.

(10) Patent No.: US 9,129,784 B2
(45) Date of Patent: Sep. 8, 2015

(54) FOURIER TRANSFORM ION CYCLOTRON RESONANCE MASS SPECTROMETER AND METHOD FOR CONCENTRATING IONS FOR FOURIER TRANSFORM ION CYCLOTRON RESONANCE MASS SPECTROMETRY

(75) Inventors: Myoung Choul Choi, Chungcheongbuk-do (KR); A Leum Park, Chungcheongbuk-do (KR); Hyun Sik Kim, Daejeon (KR); Seung Yong Kim, Daejeon (KR); Jong Shin Yoo, Daejeon (KR)

(73) Assignee: KOREA BASIC SCIENCE INSTITUTE, Daejeon (KR)

( * ) Notice: Subject to any disclaimer, the term of this patent is extended or adjusted under 35 U.S.C. 154(b) by 0 days.

(21) Appl. No.: 13/882,732

(22) PCT Filed: Nov. 21, 2011

(86) PCT No.: PCT/KR2011/008866

§ 371 (c)(1), (2), (4) Date: Apr. 30, 2013

(87) PCT Pub. No.: WO2012/074234

PCT Pub. Date: Jun. 7, 2012

(65) Prior Publication Data

US 2013/0228681 A1 Sep. 5, 2013

(30) Foreign Application Priority Data

Dec. 3, 2010 (KR) ..... 10-2010-0122559

(51) Int. Cl.
*H01J 49/02* (2006.01)
*H01J 49/06* (2006.01)
(Continued)

(52) U.S. Cl.
CPC ..... *H01J 49/02* (2013.01); *H01J 49/0027* (2013.01); *H01J 49/065* (2013.01); *H01J 49/38* (2013.01)

(58) Field of Classification Search
CPC ..... H01J 49/0031; H01J 49/38; H01J 49/67; H01J 49/425; H01J 49/0027; H01J 49/02; H01J 49/065
USPC ..... 250/282, 288, 298, 291
See application file for complete search history.

(56) References Cited

U.S. PATENT DOCUMENTS 4,535,235 A * 8/1985 McIver, Jr. ..... 250/282
4,686,365 A * 8/1987 Meek et al. ..... 250/281
(Continued)

FOREIGN PATENT DOCUMENTS

JP 2006-520072 A 8/2006
JP 2008-523554 A 7/2008
(Continued)

OTHER PUBLICATIONS

Frankevich, V., et al, "Deceleration of high-energy matrix-assisted laser desorption/ionization ions in an open cell for Fourier transform ion cyclotron resonance mass spectrometry" Rapid Commen. Mass Spectrom. 2001; 15: 2035-2040.*
(Continued)

*Primary Examiner* — Jack Berman
*Assistant Examiner* — Wyatt Stoffa
(74) *Attorney, Agent, or Firm* — Fenwick & West LLP

(57) ABSTRACT

A Fourier transform ion cyclotron resonance mass spectrometer (FT-ICR MS) includes: an ionization source generating ions; a deceleration lens, on which the ions generated by the ionization source and spatially dispersed are incident, selectively decelerating the incident ions so as to decrease the distance between the ions; and an ion cyclotron resonance cell on which the ions passing through the deceleration lens are incident. By preventing dispersing of ions due to mass difference and converging the ions using the deceleration lens, the mass range that can be measured at one time can be extended. Also, measurement sensitivity can be improved since the ions are effectively introduced to the ICR cell.

5 Claims, 6 Drawing Sheets

(51) Int. Cl.
*H01J 49/38* (2006.01)
*H01J 49/00* (2006.01)

(56) References Cited

U.S. PATENT DOCUMENTS

| | | | | |
|---|---|---|---|---|
| 7,211,794 | B2 * | 5/2007 | Malek et al. | 250/291 |
| 8,513,594 | B2 * | 8/2013 | Makarov | 250/283 |
| 2004/0217284 | A1 * | 11/2004 | Malek et al. | 250/291 |
| 2006/0273252 | A1 * | 12/2006 | Hayden et al. | 250/282 |
| 2007/0114390 | A1 * | 5/2007 | Laskin et al. | 250/288 |
| 2008/0296494 | A1 * | 12/2008 | Heninger et al. | 250/292 |
| 2009/0206248 | A1 * | 8/2009 | Makarov et al. | 250/283 |
| 2010/0065737 | A1 | 3/2010 | Bateman et al. | |
| 2011/0024619 | A1 * | 2/2011 | Makarov | 250/283 |
| 2011/0049346 | A1 * | 3/2011 | Wells | 250/282 |
| 2011/0186724 | A1 * | 8/2011 | Nolting et al. | 250/282 |

FOREIGN PATENT DOCUMENTS

| | | | |
|---|---|---|---|
| KR | 10-1994-0002515 | B1 | 3/1994 |
| KR | 10-2009-0073512 | A | 7/2009 |

OTHER PUBLICATIONS

PCT International Search Report and Written Opinion, PCT/KR2011/008866, Jun. 1, 2012, 6 Pages.

* cited by examiner

FOURIER TRANSFORM ION CYCLOTRON RESONANCE MASS SPECTROMETER AND METHOD FOR CONCENTRATING IONS FOR FOURIER TRANSFORM ION CYCLOTRON RESONANCE MASS SPECTROMETRY

TECHNICAL FIELD

Embodiments relate to a Fourier transform ion cyclotron resonance mass spectrometer (FT-ICR MS) and a method for concentrating ions for FT-ICR mass spectrometry.

BACKGROUND ART

In a Fourier transform ion cyclotron resonance mass spectrometer (FT-ICR MS), a device for ionizing a sample and an ICR cell for detecting ions are relatively distant from each other to prevent the magnetic field applied to the ICR cell from affecting the ionization device. Because of this structure, the ions generated by the ionization device spatially diffuse due to the mass difference of the ions as they travel to the ICR cell, although they are initially propagated with the same energy.

In general, the ICR cell traps the propagated ions by a method called gated trapping. In the gated trapping method, the ICR cell is configured such that incoming ions can travel freely by lowering the electric potential of an electrode at the side where the ions come in and by raising the electric potential of an electrode at the opposite side so that they cannot pass. When the ions to be detected enter the ICR cell, the electric potential of the incoming side electrode is increased to confine the ions in the ICR cell. However, since the ions reaching the ICR cell are spatially diffused due to their mass difference, only some of the ions can be trapped in the ICR cell and measured with this method. That is to say, it is difficult to detect a broad mass range at once.

DISCLOSURE OF INVENTION

Technical Problem

According to an aspect, there are provided a Fourier transform ion cyclotron resonance mass spectrometer (FT-ICR MS) and a method for concentrating ions for FT-ICR mass spectrometry in which a plurality of electrodes are provided in front of an ICR cell and diffusion of ions due to mass difference can be effectively prevented by controlling the time period for which an electric potential is applied to the electrodes and the electric potential gradient of the electrodes.

Solution to Problem

A Fourier transform ion cyclotron resonance mass spectrometer (FT-ICR MS) according to an embodiment may include: an ionization source generating ions; a deceleration lens, on which the ions generated by the ionization source and spatially dispersed are incident, selectively decelerating the incident ions so as to decrease the distance between the ions; and an ICR cell on which the ions passing through the deceleration lens are incident.

A method for concentrating ions for FT-ICR mass spectrometry according to an embodiment may include: propagating ions as the ions spatially diffuse; introducing the propagated ions to a deceleration lens; selectively decelerating the ions by the deceleration lens so as to decrease the distance between the ions; and introducing the ions passing through the deceleration lens to an ICR cell.

Advantageous Effects of Invention

The Fourier transform ion cyclotron resonance mass spectrometer (FT-ICR MS) and the method for concentrating ions for FT-ICR mass spectrometry according an aspect can prevent dispersing of ions due to mass difference and can extend the ion mass range that can be measured at one time by converging the ions. Also, measurement sensitivity can be improved since the ions are effectively introduced to the ICR cell.

MODE FOR THE INVENTION

Hereinafter, the embodiments of the present disclosure will be described in detail with reference to accompanying drawings. However, the present disclosure is not limited by the following embodiments.

Figure 1:
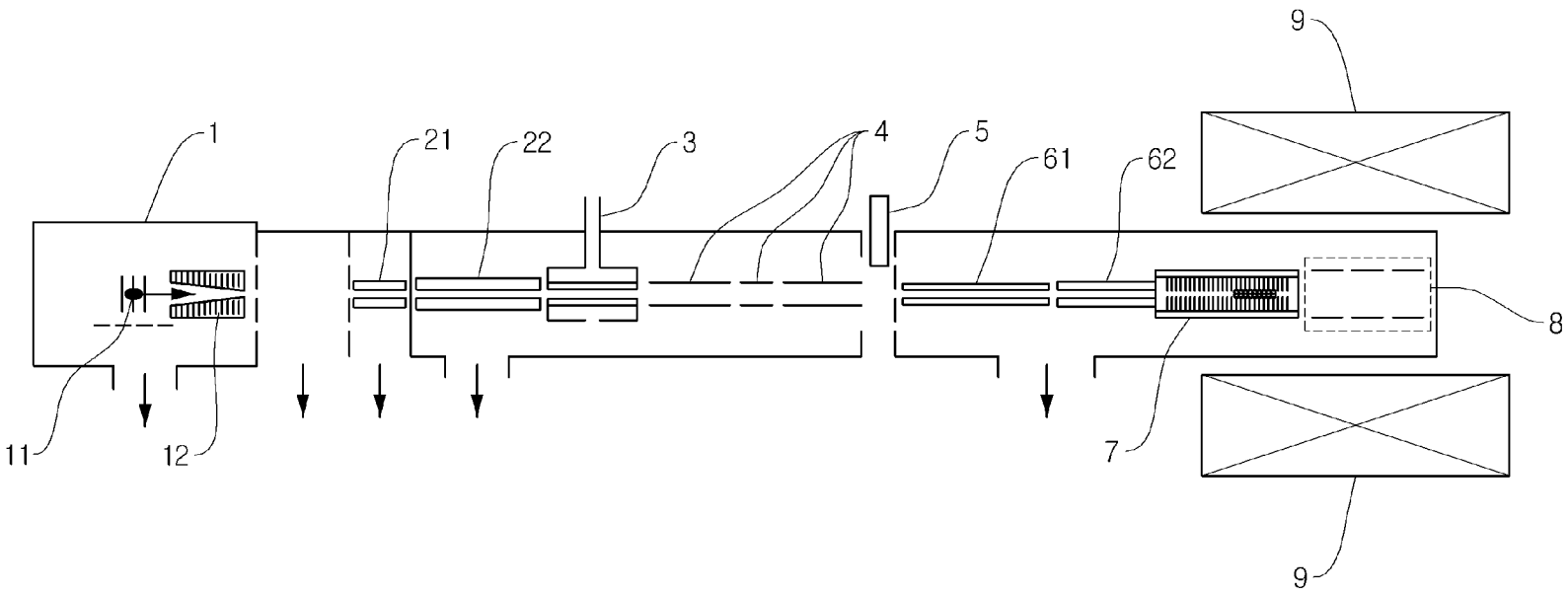
FIG. 1 is a schematic cross-sectional view of a Fourier transform ion cyclotron resonance mass spectrometer (FT-ICR MS) according to an embodiment.

FIG. 1 is a schematic cross-sectional view of a Fourier transform ion cyclotron resonance mass spectrometer (FT-ICR MS) according to an embodiment.

Referring to FIG. 1, an FT-ICR MS according to an embodiment may comprise an ionization source 1, a deceleration lens 7 and an ICR cell 8. The configuration of the FT-ICR MS shown in FIG. 1 is only an example provided for illustrating the process of converging ions. The configuration of the FT-ICR MS according to an embodiment is not limited to that shown in FIG. 1, and those skilled in the art will readily understand that some components shown in the figure can be changed and/or omitted or other components can be added.

The ionization source 1 may generate ions from a given sample 11. The ionization source 1 may generate ions from the sample 11 by means of electron ionization, chemical ionization, electrospray ionization or other suitable methods, and the embodiments of the present disclosure are not limited to a particular ionization method. The ions generated from the sample 11 may be converged by a funnel 12 and propagated toward the ICR cell 8.

The ions generated by the ionization source 1 may be introduced to a collision cell 3 through a quadrupole ion guide 21, 22. And, the ions passing through the collision cell 3 may be converged by an einzel lens 4 and introduced to an octopole ion guide 61, 62. Between a chamber wherein the einzel lens 4 is provided and a chamber wherein the octopole ion guide 61, 62 is provided, a gate valve 5 may be provided. And, each chamber wherein the ionization source 1, the quadrupole ion guide 21, 22, the collision cell 3, the einzel lens 4 or the octopole ion guide 61, 62 is provided may be exhausted to have a pressure close to vacuum. A detailed description about transportation of the ions in the FT-ICR MS will be omitted since it is well known to those skilled in the art.

The ions passing through the octopole ion guide 61, 62 may be introduced to the deceleration lens 7. The ions are introduced to the deceleration lens 7 as spatially dispersed according to their mass. The deceleration lens 7 may decelerate the incident ions by means of an electric field. Also, the deceleration lens 7 may decrease the distance between the ions dispersed according to their mass and spatially converge the ions by selectively decelerating the ions. For this, while the ions pass through the deceleration lens 7, a pulse-type electric potential may be applied to the deceleration lens 7 for a predetermined time period so as to selectively (effectively) decelerate only the ions reaching the deceleration lens 7 sooner. Also, electric potential may be applied to the deceleration lens 7 so as to form various types of electric potential gradient along the moving direction of the ions for efficient deceleration of the ions.

The ions spatially converged by the deceleration lens 7 may be introduced to the ICR cell 8. The ions may be trapped inside the ICR cell 8. Also, a magnetic field may be applied to the ICR cell 8 by a magnet 9. For example, the magnet 9 may apply a magnetic field of about 15 tesla to the ICR cell 8, although not being limited thereto. As the ions are introduced to the ICR cell 8 where the magnetic field is applied, an ICR motion of the ions may be generated in the ICR cell 8, and the mass of the ions in the ICR cell 8 may be measured using the same.

Figure 2A:
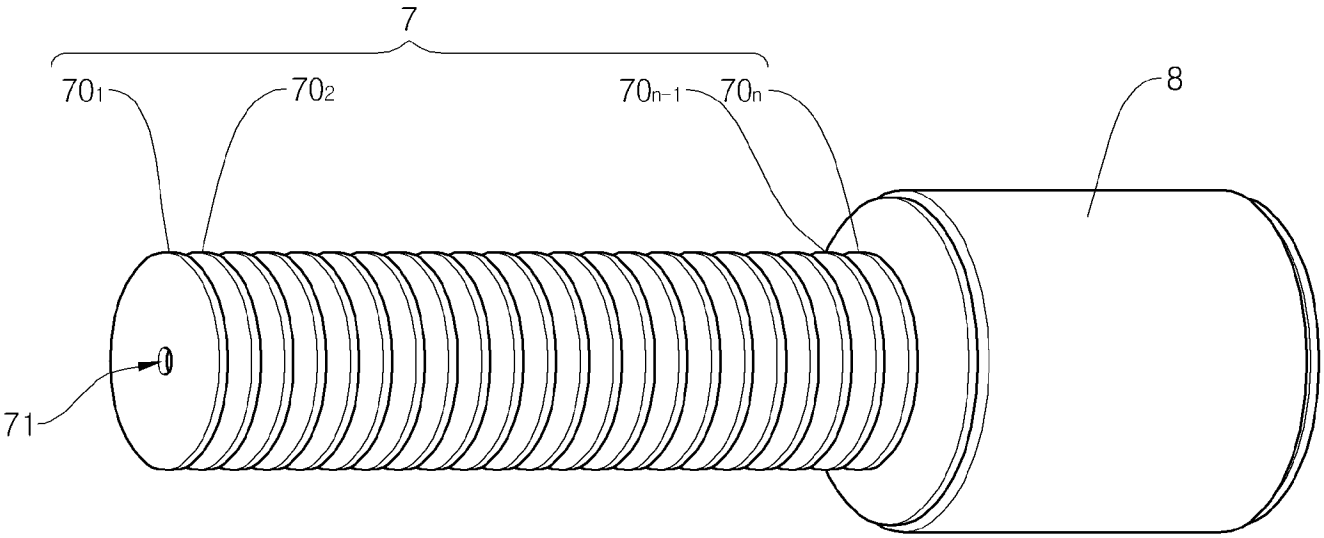
FIG. 2*a* is a perspective view of a deceleration lens and an ICR cell of an FT-ICR MS according to an embodiment.
Figure 2B:
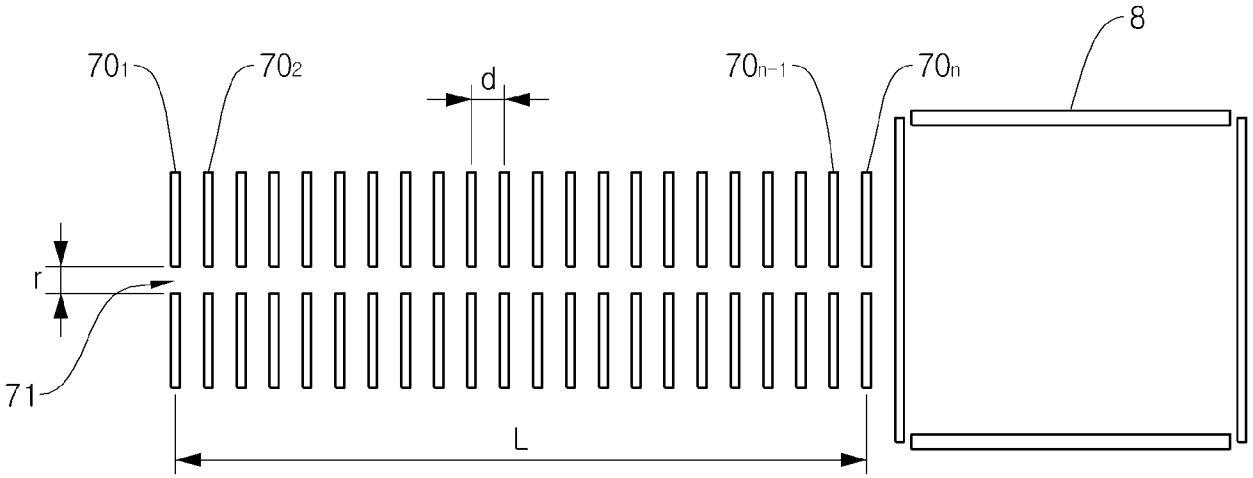
FIG. 2*b* is a cross-sectional view of the deceleration lens and the ICR cell shown in FIG. 2*a*.

FIG. 2*a* is a perspective view of a deceleration lens and an ICR cell of an FT-ICR MS according to an embodiment, and FIG. 2*b* is a cross-sectional view of the deceleration lens and the ICR cell shown in FIG. 2*a*.

Referring to FIGS. 2*a* and 2*b*, the deceleration lens 7 may comprise a plurality of electrodes $\mathbf{70}_1, \mathbf{70}_2, \ldots, \mathbf{70}_{n-1}, \mathbf{70}_n$. Each of the electrodes $\mathbf{70}_1, \mathbf{70}_2, \ldots, \mathbf{70}_{n-1}, \mathbf{70}_n$ may have a hole 71 so as to allow the passage of the ions. For example, each of the electrodes $\mathbf{70}_1, \mathbf{70}_2, \ldots, \mathbf{70}_{n-1}, \mathbf{70}_n$ may be in the form of a circular disk having a circular hole 71. In an embodiment, the hole 71 may have a diameter r of about 5 mm. The plurality of electrodes $\mathbf{70}_1, \mathbf{70}_2, \ldots, \mathbf{70}_{n-1}, \mathbf{70}_n$ may be arranged along the moving direction of the ions, and may be separated from each other. In an embodiment, the gap d between each of the electrodes $\mathbf{70}_1, \mathbf{70}_2, \ldots, \mathbf{70}_{n-1}, \mathbf{70}_n$ may be about 6 mm. In an embodiment, the number of the plurality of electrodes $\mathbf{70}_1, \mathbf{70}_2, \ldots, \mathbf{70}_{n-1}, \mathbf{70}_n$ may be 22. As a result, the total length L of the deceleration lens 7 comprising the 22 electrodes $\mathbf{70}_1, \mathbf{70}_2, \ldots, \mathbf{70}_{n-1}, \mathbf{70}_n$ may be about 126 mm.

However, in the deceleration lens 7, the number of the plurality of electrodes $\mathbf{70}_1, \mathbf{70}_2, \ldots, \mathbf{70}_{n-1}, \mathbf{70}_n$, the shape, thickness and size of each of the electrodes $\mathbf{70}_1, \mathbf{70}_2, \ldots, \mathbf{70}_{n-1}, \mathbf{70}_n$, the gap between each of the electrodes $\mathbf{70}_1, \mathbf{70}_2, \ldots, \mathbf{70}_{n-1}, \mathbf{70}_n$, the shape and diameter r of the hole 71, or the like may be determined adequately by those skilled in the art based on the kind of the ions to be measured, the magnitude of the electric potential used or other related parameters, without being limited to the description of the present specification.

While the ions pass through the deceleration lens 7 via the hole 71 of the plurality of electrodes $\mathbf{70}_1, \mathbf{70}_2, \ldots, \mathbf{70}_{n-1}, \mathbf{70}_n$, an electric potential may be applied to each of the electrodes $\mathbf{70}_1, \mathbf{70}_2, \ldots, \mathbf{70}_{n-1}, \mathbf{70}_n$ in a time-dependent manner. For example, an electric potential may not be applied to the plurality of electrodes $\mathbf{70}_1, \mathbf{70}_2, \ldots, \mathbf{70}_{n-1}, \mathbf{70}_n$ when the ions are introduced to the first electrode $\mathbf{70}_1$ of the deceleration lens 7. When a leading group of the ions passes the middle portion of the deceleration lens 7, an electric potential may be applied to the plurality of electrodes $\mathbf{70}_1, \mathbf{70}_2, \ldots, \mathbf{70}_{n-1}, \mathbf{70}_n$ to decelerate the ions. And, before an end group of the ions is introduced to the deceleration lens 7, the electric potential of the plurality of electrodes $\mathbf{70}_1, \mathbf{70}_2, \ldots, \mathbf{70}_{n-1}, \mathbf{70}_n$ may be decreased back to 0 V so as to allow the passage of the ions. As a result, by selectively decelerating the ions reaching the deceleration lens 7 sooner, the distance between the ions may be decreased and the ions may be spatially converged.

While the electric potential is applied to the deceleration lens 7, the electric potential of the plurality of electrodes $\mathbf{70}_1, \mathbf{70}_2, \ldots, \mathbf{70}_{n-1}, \mathbf{70}_n$ may form various types of electric potential gradient along the moving direction of the ions. For example, the electric potential of the plurality of electrodes $\mathbf{70}_1, \mathbf{70}_2, \ldots, \mathbf{70}_{n-1}, \mathbf{70}_n$ may be lower at the electrode near to the ionization source 1 and may be higher at the electrode nearer to the ICR cell 8. That is to say, the electric potential of the first electrode $\mathbf{70}_1$, which is nearest to the ionization source 1, may be lower than the electric potential of the second electrode $\mathbf{70}_2$. Likewise, the electric potential of the (n−1)-th electrode $\mathbf{70}_{n-1}$ may be lower than the electric potential of the n-th electrode $\mathbf{70}_n$. As a result, the intensity of the electric field experienced by the ions passing through the deceleration lens 7 may increase gradually as they travel from the first electrode $\mathbf{70}_1$ to the n-th electrode $\mathbf{70}_n$. For example, the electric potential of the plurality of electrodes $\mathbf{70}_1, \mathbf{70}_2, \ldots, \mathbf{70}_{n-1}, \mathbf{70}_n$ may increase linearly.

Figure 3A:
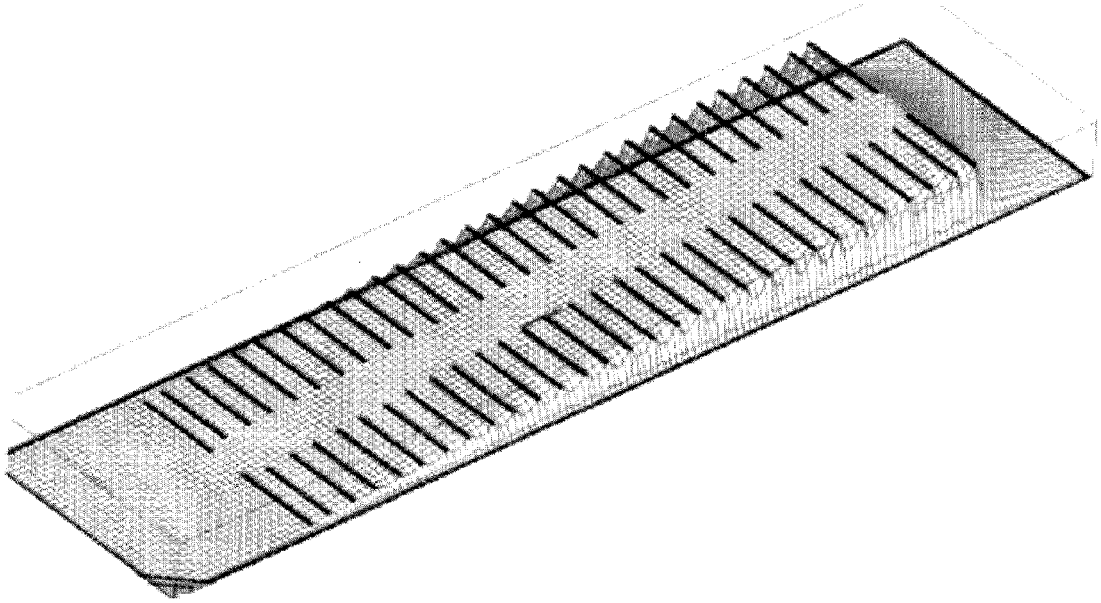
FIG. 3*a* is a schematic view illustrating an electric potential applied to a deceleration lens of an FT-ICR MS according to an embodiment.
Figure 3B:
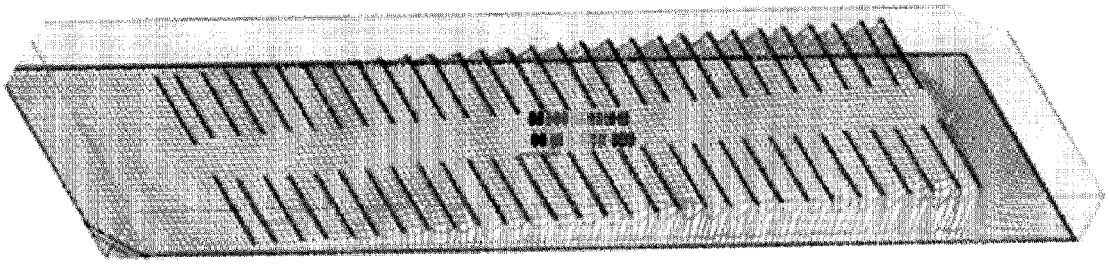
FIG. 3*b* is a schematic view illustrating ions converged by the electric potential of the deceleration lens shown in FIG. 3*a*.

FIG. 3*a* is a schematic view illustrating an electric potential applied to a deceleration lens of an FT-ICR MS according to an embodiment, FIG. 3*b* is a schematic view illustrating ions converged by the electric potential of the deceleration lens shown in FIG. 3*a*. FIGS. 3*a* and 3*b* show a computer simulation result of an electric potential of a plurality of electrodes using the simulation software SIMION. In the figures, the solid lines correspond to the electric potential of each of the electrodes $\mathbf{70}_1, \mathbf{70}_2, \ldots, \mathbf{70}_{n-1}, \mathbf{70}_n$ described above with reference to FIGS. 2*a* and 2*b*. In FIG. 3*b*, the dots of different markings denote ions of different masses. As shown in the figures, an electric potential gradient is formed along the moving direction of the ions, so that the spatially dispersed incoming ions can be spatially converged while passing through the deceleration lens.

In the embodiments described herein, it is assumed that the ions to be measured are cations (positively charged ions) and the electric potential gradient is formed such that the intensity of the electric field experienced by the ions while they pass through the deceleration lens increases gradually. That is to say, the electric potential of the plurality of electrodes in the deceleration lens may be higher at the electrode which is nearer to the ICR cell. However, this is only an example and the form of the electric potential gradient is not limited to the foregoing description. For example, when anions (negatively charged ions) are to be measured, the electric potential of the plurality of electrodes in the deceleration lens may be lower at the electrode which is nearer to the ICR cell. In addition, another form of electric potential gradient not described in the present specification may also be formed in the deceleration lens.

While FIGS. 2 and 3 illustrate the deceleration lens 7 comprising the plurality of electrodes $\mathbf{70}_1, \mathbf{70}_2, \ldots, \mathbf{70}_{n-1}, \mathbf{70}_n$, this is only exemplary and is not intended as a limitation on the configuration of the deceleration lens. In other embodiment, the deceleration lens may be a single electrode. For example, the deceleration lens may be a single electrode having the shape of a cylinder which allows passage of ions through the cylinder.

Figure 4A:
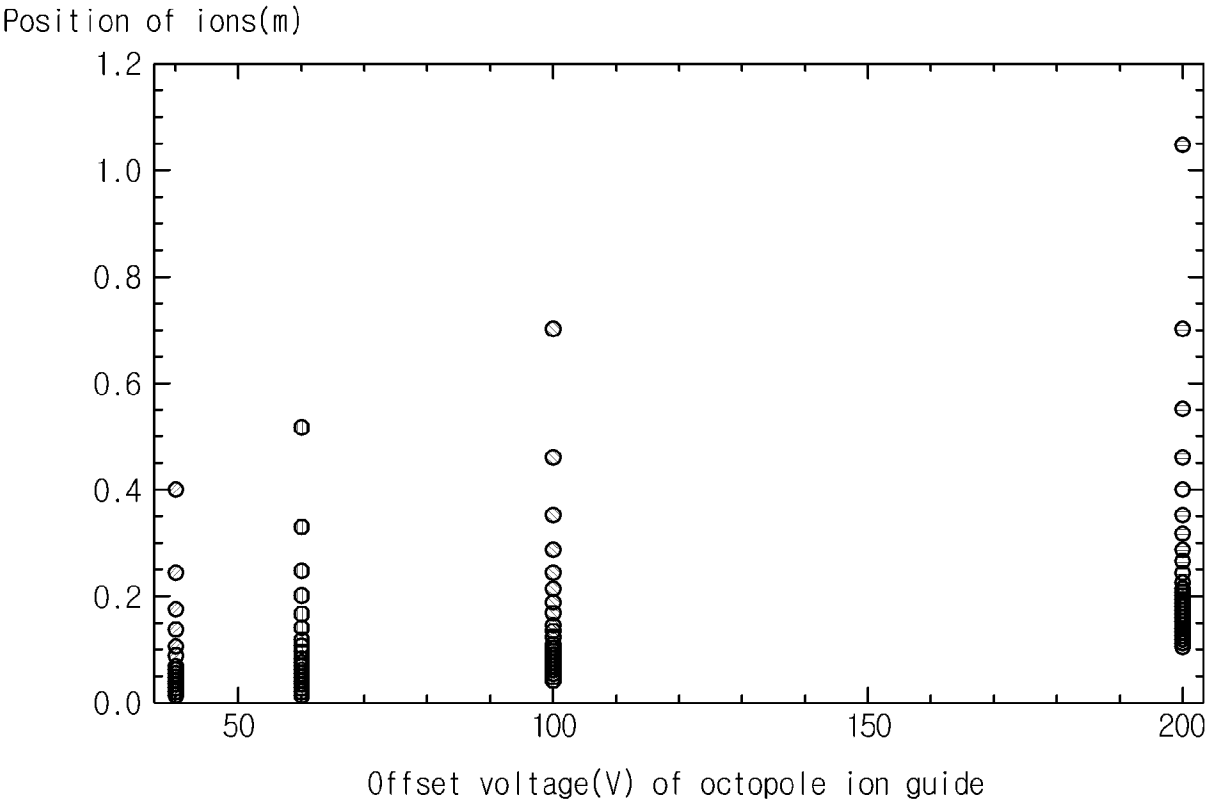
FIG. 4*a* shows the distribution of position of ions before the ions are introduced to a deceleration lens of in FT-ICR MS according to an embodiment.

FIG. 4*a* shows the distribution of position of ions before the ions are introduced to a deceleration lens of in FT-ICR MS according to an embodiment.

FIG. 4*a* shows the distribution of position of ions analytically calculated on the assumption that the ions passing through a collision cell 3 (FIG. 1) travel for about 0.6 ms and reach an octopole ion guide 61, 62 (FIG. 1). The ions have a mass distribution in the range from about 300 dalton (Da) to about 2500 Da. Although the distance traveled by the ions depends on the offset voltage of the octopole ion guide, it can be seen that, in any case, the ions are propagated as spatially dispersed. That is to say, the ion that travels the longest distance is the lightest ion (i.e., ion with a mass of about 300 Da) and that travels the shortest distance is the heaviest ion (i.e., ion with a mass of about 2500 Da).

Figure 4B:
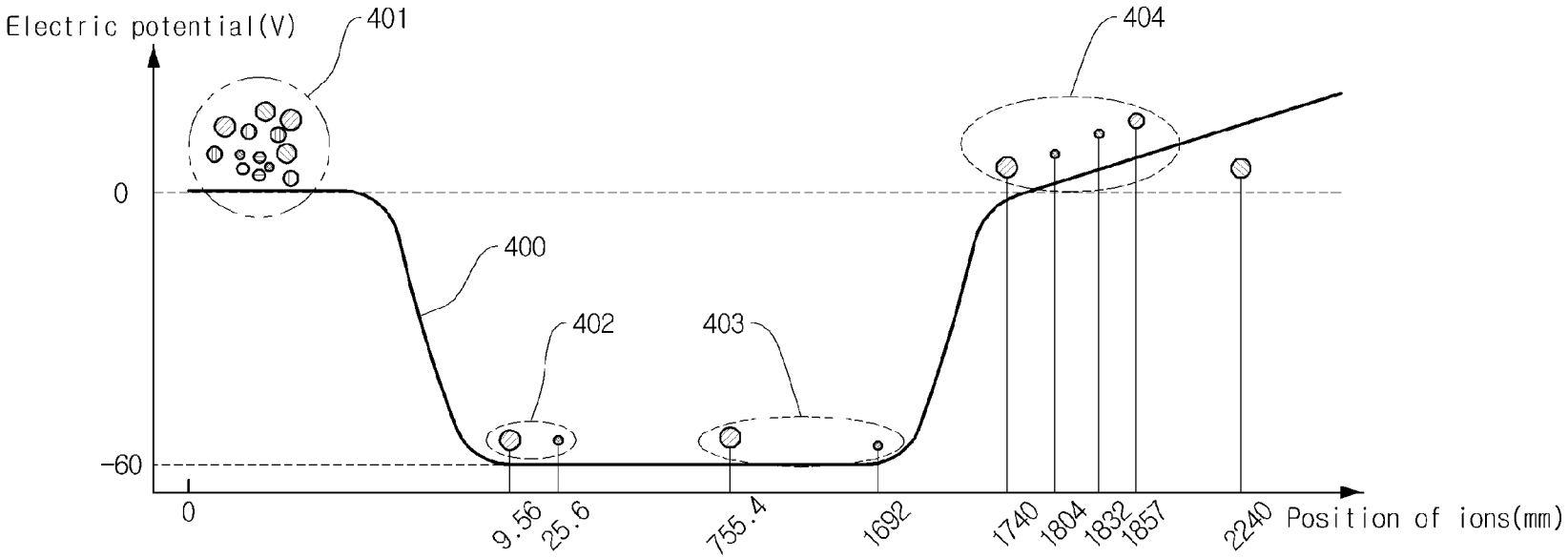
FIG. 4*b* shows the distribution of position of ions passing through a deceleration lens of in FT-ICR MS according to an embodiment.

FIG. 4*b* shows the distribution of position of ions passing through a deceleration lens of in FT-ICR MS according to an embodiment.

FIG. 4*b* shows a computer simulation result of analyzing the distribution of position of ions for the case where the ions passing through an octopole ion guide 61, 62 (FIG. 1) pass through a deceleration lens 7 (FIG. 1) and travel further. In FIG. 4*b*, the solid line 400 denotes the electric potential formed along the moving direction of the ions. As shown in the figure, the electric potential decreases from the initial value exceeding 0 V to about −60 V and then increases again to above 0 V. In FIG. 4*b*, the dots represent the ions and the size of each dot is proportional to the mass of the ion. The circles 401, 402, 403, 404 depicted with broken lines show the distribution of position of the ions with predetermined time intervals.

Initially, the ions have a kinetic energy of about 1.5 eV and are located at almost the same position, as depicted by the circle 401. However, as the ions propagate along the x-axis direction, the ions are spatially dispersed according to their mass, as depicted by the circle 402 and the circle 403. It can be seen that the distance traveled by the relatively heavier ion (depicted by the larger dot in FIG. 4*b*) is shorter than that of relatively lighter ion (depicted by the smaller dot in FIG. 4*b*). Meanwhile, in the region where the electric potential increases from about −60 V to above 0 V, the ions are selectively decelerated by the deceleration lens. As a result, the ions having different masses may be spatially converged, as depicted by the circle 404.

Now, a method for concentrating ions for FT-ICR mass spectrometry according to an embodiment will be descried referring to FIG. 1. A method for concentrating ions for FT-ICR mass spectrometry may comprise: propagating spatially dispersed ions, the ions being generated by an ionization source 1; introducing the propagated ions to a deceleration lens 7; selectively decelerating the ions by the deceleration lens 7 so as to decrease the distance between the ions; and introducing the ions passing through the deceleration lens 7 to an ICR cell 8.

The FT-ICR MS and the method for concentrating ions for FT-ICR mass spectrometry according to above-described embodiments can prevent dispersing of ions due to mass difference and can extend the ion mass range that can be measured at one time by converging the ions. Also, measurement sensitivity can be improved since the ions are effectively introduced to the ICR cell.

Those skilled in the art will appreciate that the conceptions and specific embodiments disclosed in the foregoing description may be readily utilized as a basis for modifying or designing other embodiments for carrying out the same purposes of the present disclosure. Those skilled in the art will also appreciate that such equivalent embodiments do not depart from the spirit and scope of the disclosure as set forth in the appended claims.

INDUSTRIAL APPLICABILITY

Embodiments relate to a Fourier transform ion cyclotron resonance mass spectrometer (FT-ICR MS) and a method for concentrating ions for FT-ICR mass spectrometry.

The invention claimed is:

1. A method for concentrating ions for Fourier transform ion cyclotron resonance mass spectrometry, comprising:

propagating ions as the ions spatially diffuse;

introducing the propagated ions to a deceleration lens;

selectively decelerating the ions by the deceleration lens so as to decrease the distance between the ions; and introducing the ions passing through the deceleration lens to an ion cyclotron resonance cell, wherein the propagated ions comprise a first group of ions and a second group of ions, the first group of ions being introduced into the deceleration lens sooner than the second group of ions, wherein said selectively decelerating the ions comprises decelerating the first group of ions to decrease the distance between the first group of ions and the second group of ions, and wherein said decelerating the first group of ions comprises:

initiating an application of an electric potential to the deceleration lens while the first group of ions passes the deceleration lens; and decreasing the electric potential of the deceleration lens to zero before the second group of ions is introduced into the deceleration lens.

2. The method for concentrating ions for Fourier transform ion cyclotron resonance mass spectrometry according to claim 1, wherein the deceleration lens comprises a plurality of electrodes which are arranged along a moving direction of the ions, each of the plurality of electrodes comprising a hole configured to allow passage of the ions, and wherein said decreasing the distance between the ions comprises applying the electric potential to the plurality of electrodes for a predetermined time period while the ions pass through the hole of the plurality of electrodes.

3. The method for concentrating ions for Fourier transform ion cyclotron resonance mass spectrometry according to claim 2, wherein the electric potential of the plurality of electrodes forms an electric potential gradient along the moving direction of the ions.

4. The method for concentrating ions for Fourier transform ion cyclotron resonance mass spectrometry according to claim 3, wherein the electric potential of a respective electrode among the plurality of electrodes is higher than the electric potential of an adjacent electrode among the plurality of electrodes that is further from the ion cyclotron resonance cell than the respective electrode.

5. The method for concentrating ions for Fourier transform ion cyclotron resonance mass spectrometry according to claim 3, wherein the electric potential of a respective electrode among the plurality of electrodes is lower than the electric potential of an adjacent electrode among the plurality of electrodes that is further from the ion cyclotron resonance cell than the respective electrode.

* * * * *